US008777440B2

(12) United States Patent
Eves

(10) Patent No.: US 8,777,440 B2
(45) Date of Patent: Jul. 15, 2014

(54) ILLUMINATED COLOR CHANGING INTERCHANGEABLE DRINKING VESSEL ASSEMBLY

(76) Inventor: Benjamin Eves, Chicago, IL (US)

( * ) Notice: Subject to any disclaimer, the term of this patent is extended or adjusted under 35 U.S.C. 154(b) by 49 days.

(21) Appl. No.: 13/430,927

(22) Filed: Mar. 27, 2012

(65) Prior Publication Data

US 2013/0259984 A1 Oct. 3, 2013

(51) Int. Cl.
*F21V 9/12* (2006.01)

(52) U.S. Cl.
USPC ..... 362/101; 362/318; 362/276

(58) Field of Classification Search
USPC ..... 362/101, 253, 318, 276; 446/74
See application file for complete search history.

(56) References Cited

U.S. PATENT DOCUMENTS

| | | | | | |
|---|---|---|---|---|---|
| 2,177,337 | A | * | 10/1939 | Stein | 362/154 |
| 2,532,181 | A | * | 11/1950 | Moore | 362/101 |
| 3,735,113 | A | | 5/1973 | Stott | |
| 5,070,435 | A | * | 12/1991 | Weller | 362/101 |
| 5,624,177 | A | * | 4/1997 | Rosaia | 362/101 |
| 5,671,998 | A | * | 9/1997 | Collet | 362/101 |
| 5,879,068 | A | | 3/1999 | Menashrov | |
| 5,931,558 | A | | 8/1999 | Chen | |
| 6,152,358 | A | * | 11/2000 | Bryan | 229/87.19 |
| 6,163,248 | A | | 12/2000 | Paek | |
| 6,511,196 | B1 | | 1/2003 | Hoy | |
| 6,511,197 | B1 | | 1/2003 | Kalemjian | |
| 6,746,132 | B2 | * | 6/2004 | Liu | 362/101 |
| 6,793,362 | B2 | | 9/2004 | Tai | |
| 6,923,549 | B2 | | 8/2005 | Hoy | |
| 6,955,443 | B2 | | 10/2005 | Solowiej | |
| D514,387 | S | | 2/2006 | Rockwell | |
| 7,018,062 | B2 | | 3/2006 | Taylor | |
| 7,040,776 | B2 | | 5/2006 | Harrell | |
| 7,452,096 | B2 | * | 11/2008 | Ichikawa | 362/101 |
| 7,926,966 | B2 | | 4/2011 | Winters | |
| 7,976,177 | B2 | * | 7/2011 | Dikopf | 362/101 |
| 2003/0081408 | A1 | | 5/2003 | Tai | |
| 2004/0017678 | A1 | | 1/2004 | Liu | |
| 2004/0047147 | A1 | | 3/2004 | Hoy | |
| 2004/0202751 | A1 | | 10/2004 | Mckay | |
| 2005/0047114 | A1 | | 3/2005 | Harrell | |
| 2005/0068502 | A1 | | 3/2005 | Mau | |

* cited by examiner

*Primary Examiner* — Peggy Neils
(74) *Attorney, Agent, or Firm* — Howard B. Rockman; Mercedes V. O'Connor

(57) ABSTRACT

An illuminated, color-changing, interchangeable drinking vessel assembly that includes an upper fluid retaining vessel, a neck, a collar on a stem, and a base. Magnets are located in the neck of the upper fluid retaining vessel and light emitting diodes (SMD LED's) and a magnetically actuated switch are located in the collar of the stem. A controller and battery are located in the base of the stem and are also electrically connected to the light emitting diodes. When the upper fluid retaining vessel and neck are magnetically attached to the collar of the stem, the magnetically operated switch detects the magnetic field and closes the circuit, activating the SMD LED's.

20 Claims, 4 Drawing Sheets

ILLUMINATED COLOR CHANGING INTERCHANGEABLE DRINKING VESSEL ASSEMBLY

BACKGROUND OF THE INVENTION

1. Field of the Invention

The present invention relates to an illuminated drink holding vessel assembly constructed to light up, change colors, and hold liquids, and in an embodiment, a liquid comprising reflective digestible particles, used in combination with the illuminated vessel.

2. Description of the Prior Art

Illuminated drinking vessels are well known. For practical purposes, they illuminate the fluid retained by the vessel's vessel, and the rim and side walls of the vessel, for aesthetic purposes. The illuminated drinking vessels of the prior art are generally one, inseparable piece and do not use a magnetically actuated switch to activate the light emitting means of the vessel.

U.S. Pat. No. 5,879,068 discloses an illuminated drinking vessel (FIG. 4) that comprises an upper fluid-retaining vessel 12 and a lower hollow supporting stem 14. The upper vessel 12 and the lower stem 14 are not separable. An LED 28 extends upwardly from the hollow stem 14 and is disposed within a prismatic bubble 16 located in a lower end of the upper vessel 12. The vessel has two switch mechanisms in which to close first and second circuits between the LED and the battery.

The first switch mechanism 26 closes the first circuit between the LED 28 and the battery 34, and comprises a lift switch which is exteriorly mounted on the stem 14 adjacent to a lower end 18 of the upper vessel 12. To actuate this first switch and illuminate the vessel, the user grasps the supporting stem when lifting the drinking vessel.

The second switch mechanism 30 closes the second circuit 38 between the LED 28 and the battery 34, and is mounted adjacent to a lower end of the supporting stem 14. The second switch 30includes a movable base plate 32 that supports the stem when placed on a horizontal surface, and a micro-switch which is responsive to the vertical positioning of the base plate 32. Springs 40 are provided for biasing the base plate downwardly relative to the lower end of the supporting stem 14. To actuate this second switch and illuminate the vessel, the user fills the upper vessel 12 with a fluid when the supporting stem 14 is resting on a horizontal surface. The added weight of the liquid will apply a downward force to the springs and in turn will close the circuit. Patent '068 does not disclose interchangeable stem and vessel parts or a magnetic switch activation when a separable vessel is placed on a stem.

U.S. Pat. No. 5,931,558 discloses a gleamy goblet structure comprising a housing 8, a plurality of small colored bulbs 9, a mercury cell 10, and a multisection switch 4. The small colored bulbs 9 are located at the connecting base 15 between the upper vessel 2 and the lower stem 3. The bottom of the stem 3 houses the battery 10 and the multisection switch 4. The multisection switch 4 can turn on a single bulb to produce one color or turn on several bulbs to produce a combination of other colors. Patent '558 discloses illuminated stemware but does not disclose interchangeable stem and vessel parts or magnetic switch activation.

U.S. Pat. No. 6,746,132 discloses a non-invasively actuated illuminated drinking vessel 2 and base 6, the base unit 10 comprising an LED 12, a battery 20, and a mechanism for activating and de-activating the LED's. (FIG. 1). The switch mechanism preferably includes a magnet 90 that is located approximately the same radial distance from the center 83 of the base unit as the overlapping section ends 62 and 71. FIGS. 4 and 5 depict the OFF and ON positions, respectively. When magnet 90 is not aligned with section ends 62 and 71, the circuit is open and the vessel is not illuminated, as shown in FIG. 4. To actuate the switch, the user rotates the base unit 10 to align magnet 90 with section ends 62 and 71, closing the circuit and illuminating the vessel, as shown in FIG. 5. Although the '132 patent discloses a magnet in the switch, it does not disclose stemware, interchangeable parts, nor a structure whereby interchanging the vessel on the stem actuates the magnetic switch.

U.S. Pat. No. 6,955,443 discloses a illuminated wine and drinking glass base, the base comprising a battery holder 9, an on/off switch 8, and an LED 7 covered by a flat, removable membrane material 15, shown in FIG. 2. The top of the narrow portion of the glass base has an aperture 2 in which to permanently affix a glass stem 11 of a wine glass 12, shown in FIG. 7. The LED 7 is mounted to point directly up through the top of the narrow portion of the glass base, allowing the base to vary in color with the LED. To actuate switch 8, a user manually switches on/off through an aperture 5 in the covering membrane. Patent '443 discloses stemware and an LED but does not disclose interchangeable stem and vessel parts or a magnetic activation switch.

U.S. Pat. No. 7,976,177 discloses an internally illuminated bottle. Specifically referring to FIG. 7, the invention comprises a two-piece bottle 70. The LED 74, battery 79, and switch 75 are housed within the bottom chamber 73 of the outer portion 72. If a reed-type hermetic switch is used, the outer portion 72 can be used as a glass to drink the beverage contained within the bottle. If a magnet is mounted within the bottom cavity 71B of the bottom portion 76, then separating the inner bottle 76 from the outer portion 72 would open the LED circuit and illuminate LED 74. Replacing the outer portion 72 would turn the LED off. This embodiment discloses a reed switch and illumination being dependent on the separation of two parts, however, it does not disclose stemware or interchangeable stem and vessel parts.

U.S. patent publication 2004/0202751 discloses an illuminated beverage-holding device comprising a beverage-holding portion 12 and a base 14. The base 14 contains LED 26, battery 28, and switch 30, shown in FIG. 3. The upper stem 20, connecting the beverage-holding portion 12 to the stem 20, contains a light-directing structure 18 that directs light to the inner and outer walls of the beverage-holding portion, rather than directly through the liquid. Publication '751 does not disclose interchangeable stem and vessel parts or a magnetic activation switch.

The prior art to date does not disclose the combination of an illuminated drinking vessel comprising stemware, interchangeable parts and a magnetic switch actuation. None of the prior art can be combined in this way to suggest these necessary modifications. There is no teaching, suggestion, or motivation that would have enabled a person of ordinary skill in the art to modify any prior art illuminated drinking vessels to allow interchangeable stemware vessels and a reed switch actuation.

It is a primary object of the present invention to provide an illuminated drinking vessel for aesthetically illuminating the fluid, the stemware and its surroundings.

Another object of the present invention is to provide users with an electrolyte drink mix that reflects light from the light emitting means of the illuminated drinking vessel so the vessel and the fluid are used in conjunction and hydrate the user.

Still another object of the present invention is to provide users with an easy way of storing the stemware by allowing the user to separate the upper and lower portions of the illuminated drinking vessel and magnetically affix each to a metal surface.

Still another object of the present invention is to provide users with an easy way of cleaning the stemware by allowing the user to separate the upper and lower portions of the illuminated drinking vessel.

SUMMARY OF THE INVENTION

The illuminated, color changing, interchangeable drinking vessel and stemware assembly of the present invention comprises two interchangeable, separate pieces: a removable glass or other transparent material top piece, called the vessel, and a stem. The assembly in the illustrative embodiment (FIG. 1) of the present invention has four parts: removable, glass top vessel (FIGS. 1, 2, 3), having at its bottom an acrylic vessel neck portion which holds neodymium disc magnets or equivalent; a collar, located at the top of the stem, which collar holds a magnetically activated switch that is activated by the field generated by the neodymium magnets in the vessel neck, and SMD LED lights mounted on a PCB (printed circuit board); a stem with a surgical steel hollow tube that conceals wires going from the base to the collar; and a base, located at the bottom of the stem, which holds another PCB, that controls the color changing sequence of the SMD LED's, a lithium-ion or lithium polymer battery or equivalent, and a charging connector where a removable battery charger attaches.

The stemware in the illustrative embodiment lights up via SMD LED lights built into the top or collar portion of the stem. The SMD LED lights are powered by a rechargeable lithium battery located in the base of the stemware. Other light emitting elements and power supply elements may be used, as are known in the art. The stemware is modular in that the stem portion can accommodate multiple interchangeable top pieces, such as a stemless martini glass, a stemless champagne flute and a stemless wine glass, by way of example. The stemware may also be used to hold an energy or vitamin beverage.

In an embodiment of the illuminated drinking vessel, a one or multiple piece vessel holds a beverage that includes reflective digestible particles adapted for human consumption. A portion of the vessel is translucent, and a light emitting source selectively directs light through the translucent portion of the vessel. Simultaneously, light directed through the beverage is reflected from the reflective digestible particles in the beverage, adding to the visual display provided by the present invention.

BRIEF DESCRIPTION OF THE DRAWINGS

The present invention is further described with reference to the accompanying drawings in which.

DETAILED DESCRIPTION OF THE ILLUSTRATED EMBODIMENTS

Figure 1:
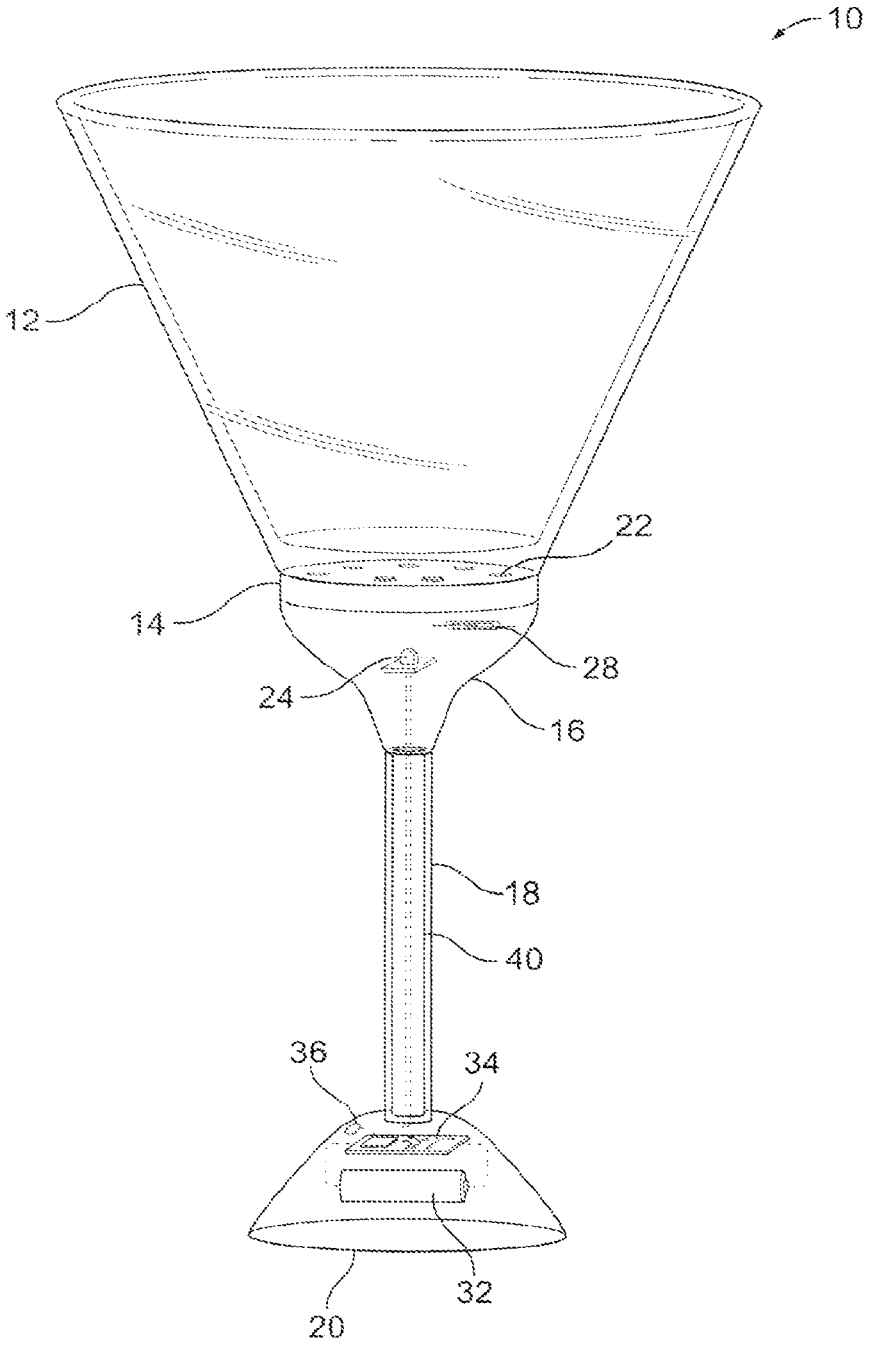
FIG. 1 is a schematic cross-sectional view of an embodiment of the illuminated drinking vessel and stem combination of the present invention.
Figure 2:
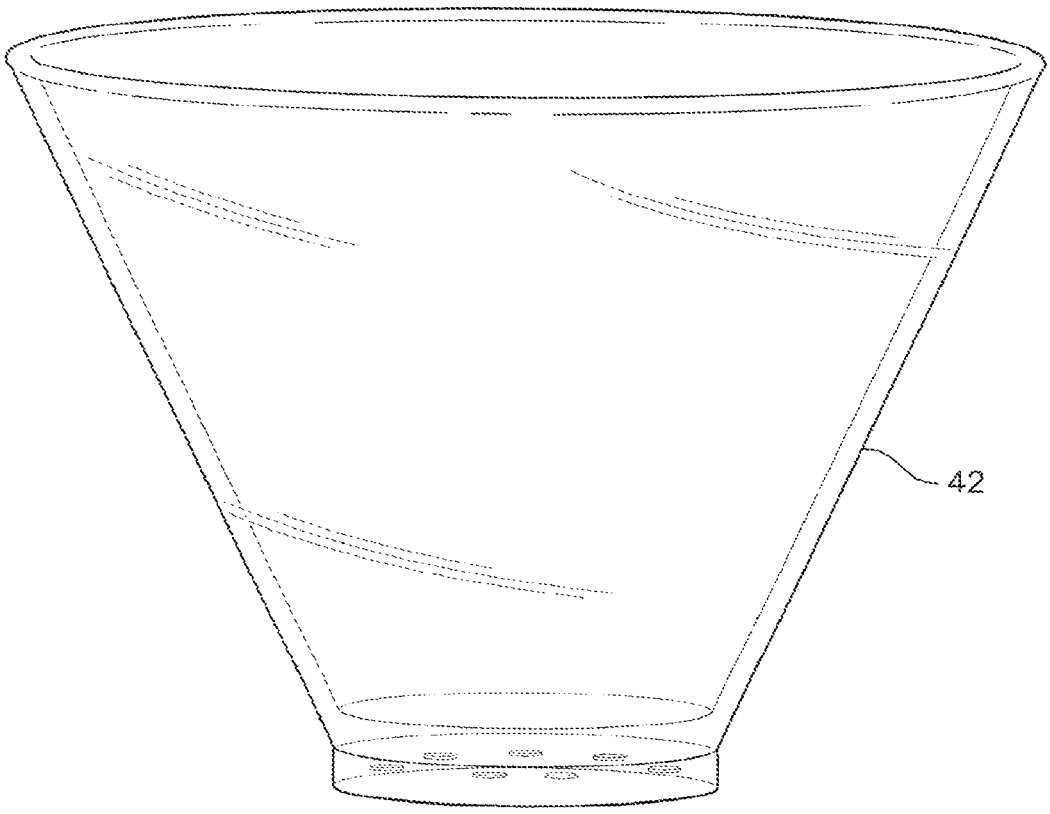
FIG. 2 is a side perspective view of an embodiment, a martini glass, of the upper fluid retaining vessel of FIG. 1.
Figure 3:
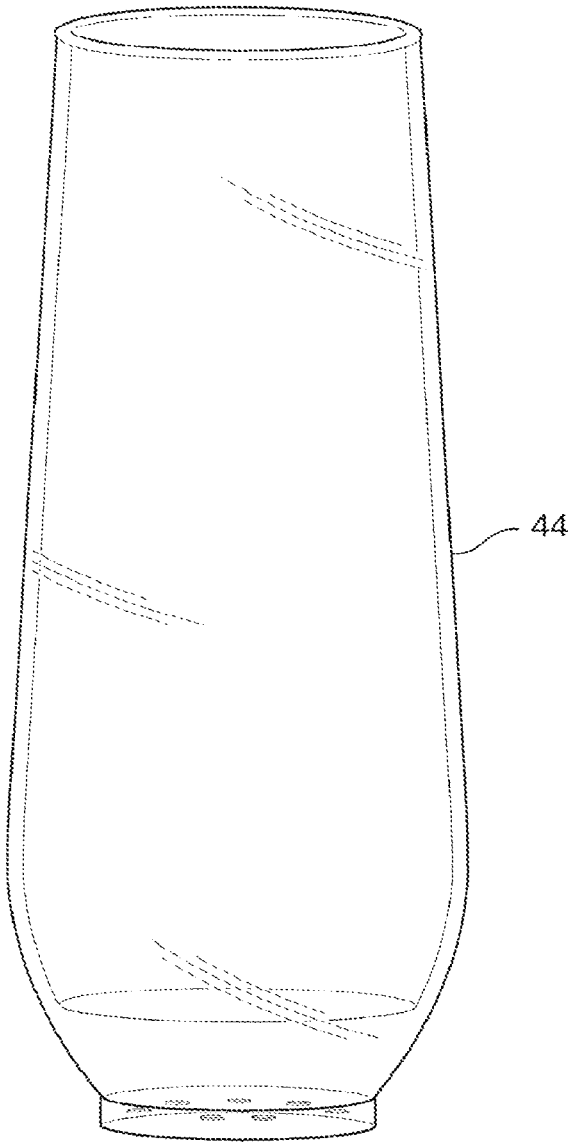
FIG. 3 is a side perspective view of an embodiment, a champagne flute, of the upper fluid retaining vessel of FIG. 1.
Figure 4:
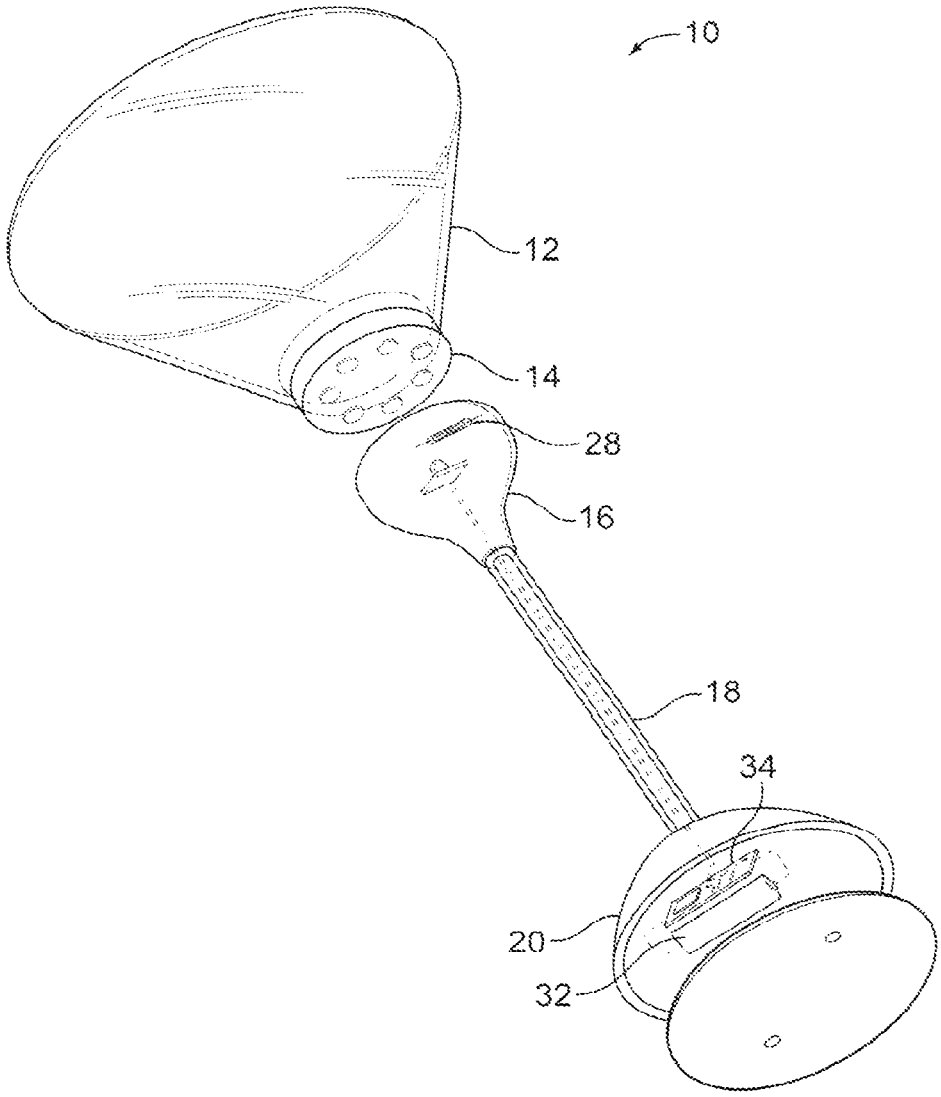
FIG. 4 is an exploded perspective view of an embodiment of the illuminated drinking vessel and stem combination of the present invention.

Referring to FIG. 1, the illuminated drinking vessel and stem combination 10 comprises an upper fluid retaining vessel 12, a collar 16, a hollow stem housing chamber 18, and a base 20 (also shown in FIG. 4). The upper fluid retaining vessel 12 may be any shape, such as a martini glass 42 of FIG. 2 or a champagne flute 44 of FIG. 3. The upper fluid retaining vessel 12 is made of glass in the illustrated embodiment, and includes an acrylic neck or bottom portion 14, enclosing an array of neodymium magnets 22 or other magnets. The vessel 12 could also be made of other translucent materials, as are known in the art. The neck 14 is adhesively attached to the bottom of the upper fluid retaining vessel 12. In another embodiment, the neck 14 can be integrally formed with the fluid retaining vessel 12. The stem 18 is made of Pyrex glass tubing or the like, and encloses a surgical steel tube 40 that conceals the solid copper wires 38 (not shown) extending from the base 20 of the stem 18 to the collar 16 of the stem 18.

The collar 16 of the stem 18 is made of a machined acrylic composite or equivalent and encloses RGB (Red, Green, Blue) surface mounted light emitting diodes (SMD LED) 24, each capable of any combination or sequence of Red, Green, and Blue colors across the color spectrum, mounted onto a printed circuit board (PCB) (not shown). The collar 16 also encloses a magnetically activated reed switch 28, and a metal washer 30 (not shown).

The base 20 is made of either machined aluminum, stainless steel, or other suitable materials as are known in the art. The base 20 encloses a power source 32, such as a lithium-ion or lithium-polymer battery, another PCB controller 34, and a connector 36 (not shown) in which a charger for the battery 32 is attached. The PCB 34 controls the color of the RGB SMD LED's 24, and is connected to the battery 32, SMD LED's 24, charging connector, and reed switch 28 via the copper wires 38 that extend from the base 20 to the collar 16 through the surgical steel tube 40.

The reed switch 28 of the illustrated embodiment operates by opening an electrical circuit when there is no magnetic field present or near the reed switch 28. A user simply attaches the neck 14 of the upper fluid retaining vessel 12, which contains magnets 22, to the collar 16 of the stem 18, which contains a metal washer 30, to create a magnetic field. The magnetic field provides a triggering mechanism that simultaneously causes the magnetically activated reed switch 28 to close the electrical circuit and activate the SMD LED's 24, and also holds the neck 14 of the upper fluid retaining vessel 12 onto the collar 16 of the stem 18. The magnetic field also allows for easy storage of the upper fluid retaining vessel 12 and neck 14, by attaching the vessel bottom to any metal object when not in use.

The illuminated, color-changing interchangeable stemware assembly 10 could be made available to a restaurant, bar or other venue where beverages are served, with the condition that the stemware be used with a specific drink mix. For example, illuminated drinking vessel may be filled with an electrolyte energy drink mix including reflective digestible particles that only reflect light generated from the SMD LED's 24 when the retaining vessel 12 is magnetically attached to the collar 16 and the magnetically activated reed switch 28 closes the electrical circuit to light the LEDs. The reflective particles in the liquid can be any of the following: salts; vitamins or minerals such as: calcium, coral calcium, magnesium, potassium manganese, zinc, vitamins A, B, C, D, E, K; amino acids such as: L-Tyrosine, Glycine, Taurine; seeds such as Chia Seeds; natural or artificial flavors; artificial sweeteners such as Sucrose® or Stevia®; or any of the like which change the transparency or viscosity of the liquid that is combined with the drink mix.

In a further embodiment of the present invention, the beverage comprising reflective digestible particles is provided separately, and can be used in combination with one or multi-piece illuminated vessels. In practice, users of an illuminated vessel of any type could add a beverage containing reflective digestible particles to the vessel, such that the light passes through the beverage, and a portion of the light is reflected from the particles, providing a sparkling effect in the beverage.

The foregoing description of an illustrated embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed:

1. An illuminated drinking vessel assembly, comprising:

a. an upper fluid retaining vessel;

b. a neck permanently attached to said upper fluid retaining vessel, said neck including a plurality of magnets;

c. a collar removably and magnetically attached to said neck, said collar including an actuator and at least one light emitting element;

d. a hollow stem permanently attached to said collar;

e. a base permanently attached to said hollow stem, said base including a power supply electrically and selectively connected to said at least one light emitting element.

2. The illuminated drinking vessel assembly of claim 1, wherein the at least one light emitting element comprises a plurality of light emitting elements of differing colors.

3. The illuminated drinking vessel assembly of claim 1, wherein the magnets are neodymium disc magnets.

4. The illuminated drinking vessel assembly of claim 1, wherein the actuator is a reed switch, said reed switch activated by the magnets in said neck when said fluid retaining vessel is magnetically attached to said collar.

5. The illuminated drinking vessel assembly of claim 1, wherein the at least one light emitting element comprises at least one surface mounted device (SMD) light emitting diode.

6. The illuminated drinking vessel assembly of claim 1, wherein the at least one light emitting element is mounted on a first printed circuit board.

7. The illuminated drinking vessel assembly of claim 1, wherein the power source is one of a lithium-ion battery and a lithium polymer battery.

8. The illuminated drinking vessel assembly of claim 6, wherein the power source is connected to a second printed circuit board which controls the at least one light emitting element.

9. The illuminated drinking vessel assembly of claim 1, wherein the base includes a connector adapted to receive a power source charger.

10. The illuminated drinking vessel assembly of claim 1, wherein wires connecting the power source in the base to the at least one light emitting element in the collar extend through the hollow stem.

11. The illuminated drinking vessel assembly of claim 4, wherein the reed switch is actuated when the upper retaining vessel and neck are placed onto the collar of the hollow stem.

12. The illuminated drinking vessel assembly of claim 1, wherein the upper fluid retaining vessel holds a beverage mix.

13. The illuminated drinking vessel assembly of claim 1, wherein the upper fluid retaining vessel holds an electrolyte beverage mix.

14. The illuminated drinking vessel assembly of claim 13, wherein the electrolyte beverage mix includes reflective digestible particles.

15. The illuminated drinking vessel assembly of claim 12, wherein the beverage mix reflects light from the at least one light emitting element of the illuminated drinking vessel assembly.

16. The illuminated drinking vessel assembly of claim 13, wherein the electrolyte beverage mix reflects the light from the at least one light emitting element of the illuminated drinking vessel assembly.

17. The illuminated drinking vessel assembly of claim 14, wherein the reflective digestible particles in the electrolyte beverage mix reflect the light from the at least one light emitting element of the illuminated drinking vessel assembly.

18. The illuminated drinking vessel of claim 14, wherein the reflective digestible particles are selected from the group consisting of digestible salts, vitamins, minerals, amino acids, seeds, natural flavors, artificial flavors and artificial sweeteners.

19. An illuminated drinking vessel, comprising:

a. an upper fluid retaining vessel;

b. a neck portion of said fluid retaining vessel, said neck portion including at least one magnet;

c. a hollow stem having a collar attached to the hollow stem, the neck portion of said fluid retaining vessel removably and magnetically attached to said collar;

d. said stem attached to a base, the base including a source of electrical power;

e. the collar including at least one light emitting element and a magnetically actuated switch electrically connected to the at least one light emitting element; and f. the source of electrical power electrically connected to the magnetically actuated switch.

20. An illuminated drinking vessel assembly, comprising:

a. an upper fluid retaining vessel;

b. a neck permanently attached to said upper fluid retaining vessel, said neck including a triggering mechanism;

c. a collar removably attached to said neck, said collar including an actuator and at least one light emitting element, said actuator being activated when said triggering mechanism in said neck comes into proximity with said actuator;

d. a hollow stem permanently attached to said collar;and e. a base permanently attached to said hollow stem, said base including a power supply electrically and selectively connected to said at least one light emitting element, said power supply contained entirely within said base.

* * * * *